United States Patent [19]

Lohr

[11] 4,138,112

[45] Feb. 6, 1979

[54] MOVING TARGET GAME WITH IMPACT DEVICE

[76] Inventor: Raymond J. Lohr, 5043 Sterrettania, Erie, Pa. 16506

[21] Appl. No.: 812,703

[22] Filed: Jul. 5, 1977

[51] Int. Cl.[2] ..... A63F 9/02; F41J 9/00

[52] U.S. Cl. ..... 273/101.2; 273/105.2

[58] Field of Search ..... 273/101.2, 108, 105.2, 273/120 R

[56] References Cited

U.S. PATENT DOCUMENTS

| | | | |
|---|---|---|---|
| 644,867 | 3/1900 | McCullough | 273/101.2 |
| 1,546,284 | 7/1925 | Helling | 273/101.2 |
| 2,484,912 | 10/1949 | Shenker | 273/101.2 |
| 2,782,037 | 2/1957 | Rovira | 273/122 R |
| 3,559,637 | 2/1971 | Fyanes | 273/86 C |
| 3,620,534 | 11/1971 | Einfalt | 273/101.2 |
| 4,042,242 | 8/1977 | Nicholls et al. | 173/105.2 |

FOREIGN PATENT DOCUMENTS

| | | | |
|---|---|---|---|
| 348888 | 2/1922 | Fed. Rep. of Germany | 273/20 R |
| 2205218 | 8/1973 | Fed. Rep. of Germany | 273/101.2 |
| 2404712 | 8/1975 | Fed. Rep. of Germany | 273/105.2 |
| 459077 | 12/1936 | United Kingdom | 273/101.2 |

*Primary Examiner*—Vance Y. Hum
*Assistant Examiner*—Lawrence E. Anderson
*Attorney, Agent, or Firm*—Charles L. Lovercheck

[57] ABSTRACT

A target game made up of a track on an inclined support, a gun which can be aimed at cars running down the track, an impactor under the support which, when the gun is properly aimed in elevation and azimuth, will engage one of several rods, which are connected to bell cranks which will move blades upward through the support to engage a car and knock it off the track, if the trigger is pulled at the proper time.

12 Claims, 10 Drawing Figures

MOVING TARGET GAME WITH IMPACT DEVICE

REFERENCE TO PRIOR ART

The present invention constitutes an improvement over all prior art knwon to the inventor.

REFERENCE TO PRIOR APPLICATIONS

Applicant has no prior applications for patent on the target game disclosed herein.

OBJECTS OF THE INVENTION

It is an object of the invention to provide an improved target game.

Another object of the invention is to provide an improved actuating mechanism in a target game.

Another object of the invention is to provide a target game that is simple in construction, economical to manufacture and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

GENERAL DESCRIPTION OF DRAWINGS

FIG.. 3 is an end view of the track support.

Figure 1:
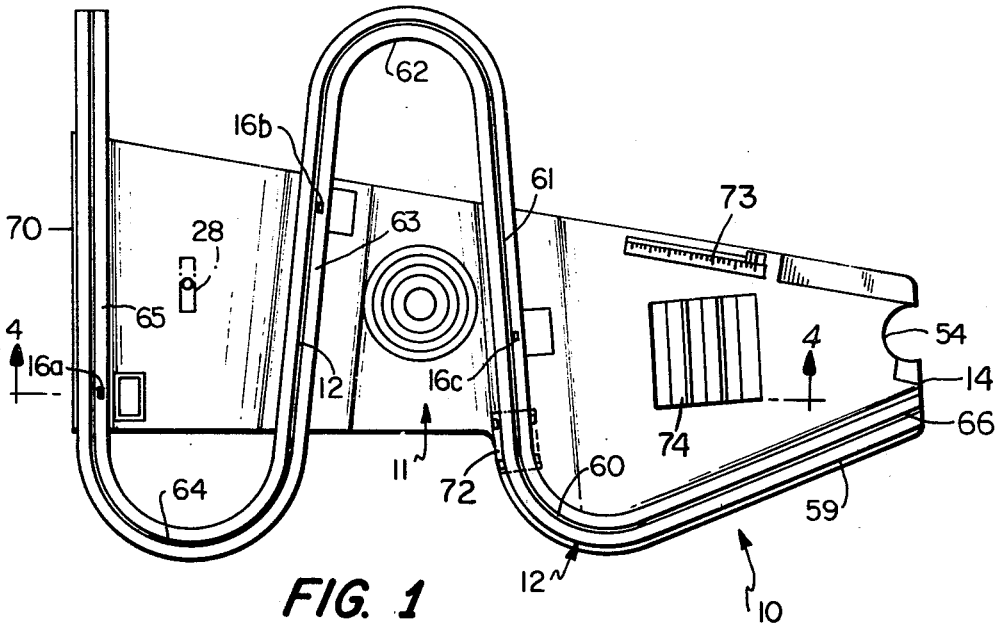
FIG. 1 is a top view of the track and track support according to the invention.
Figure 2:
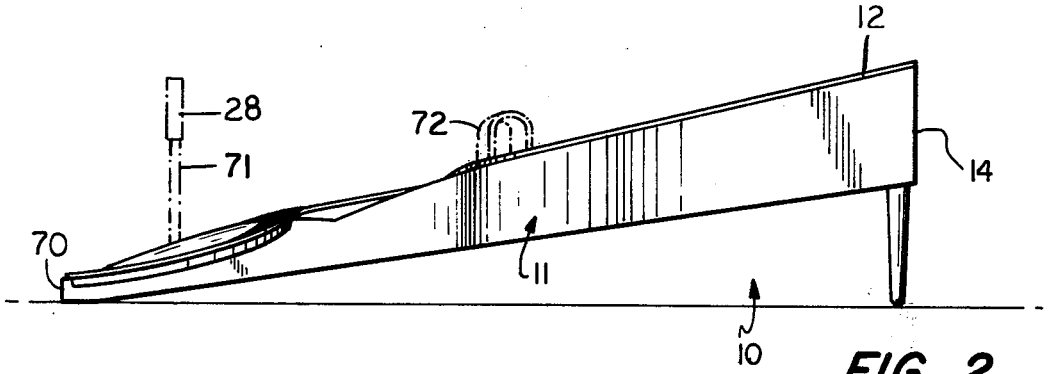
FIG. 2 is a side view of the track support.
Figure 3:
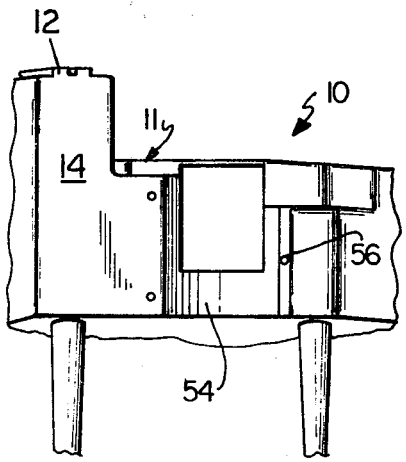
Figure 4:
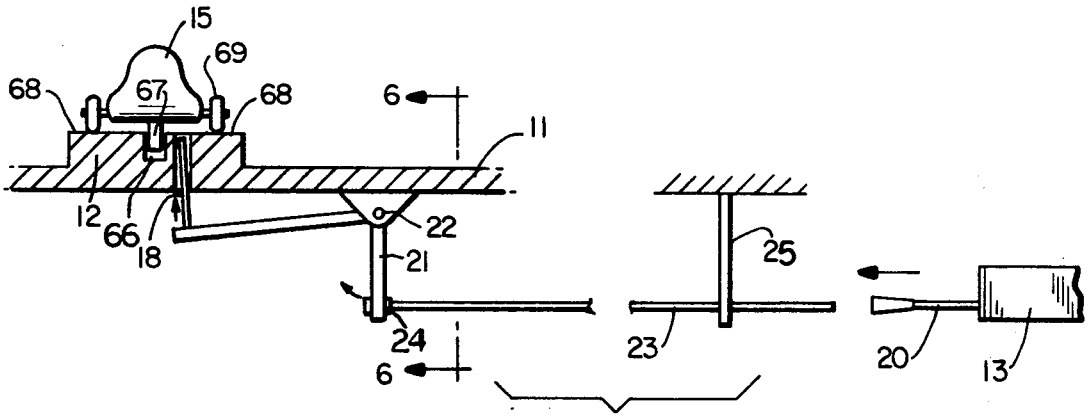

FIG. 4 is a longitudinal, cross-sectional view taken on line 4—4 of FIG. 1 of the track support showing the impact means.

Figure 5:
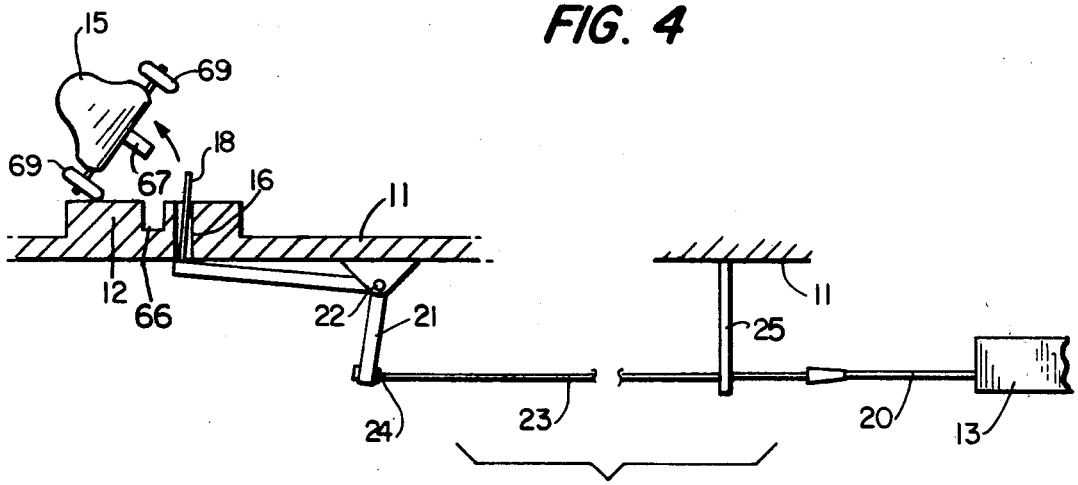

FIG. 5 is a longitudinal cross-sectional view taken on line 4—4 of FIG. 1 with the impact means actuated.

Figure 6:
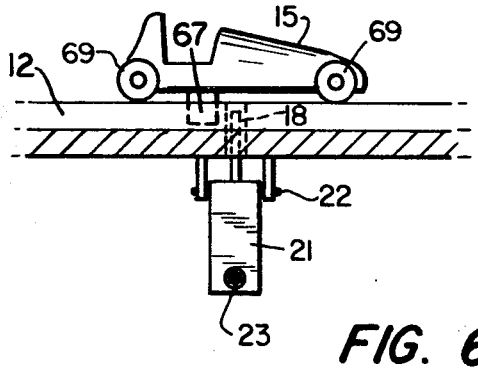

FIG. 6 is a cross-sectional view taken on line 6—6 of FIG. 4.

Figure 7:
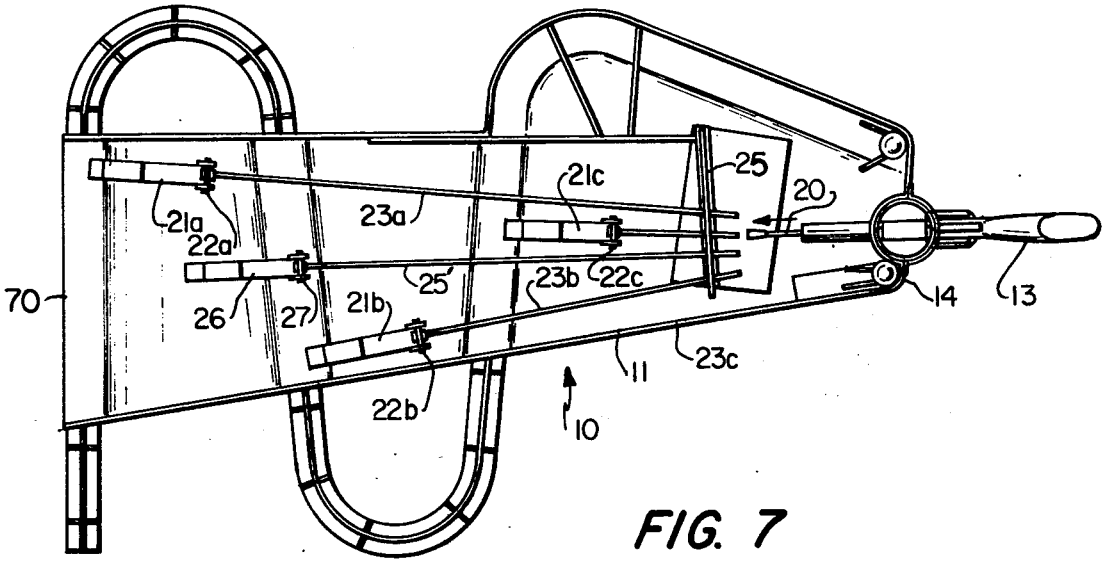

FIG. 7 is a bottom view of the track support, track, impact means and gun mechanism.

Figure 8:
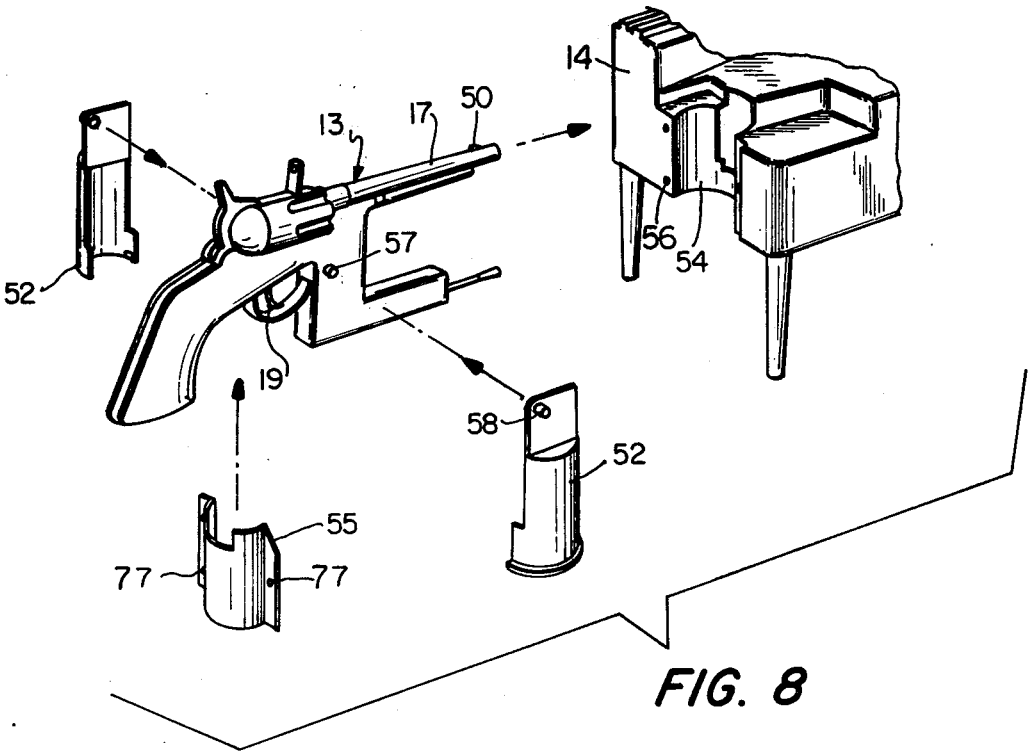

FIG. 8 is an exploded view of the gun, track support and gun support.

Figure 9:
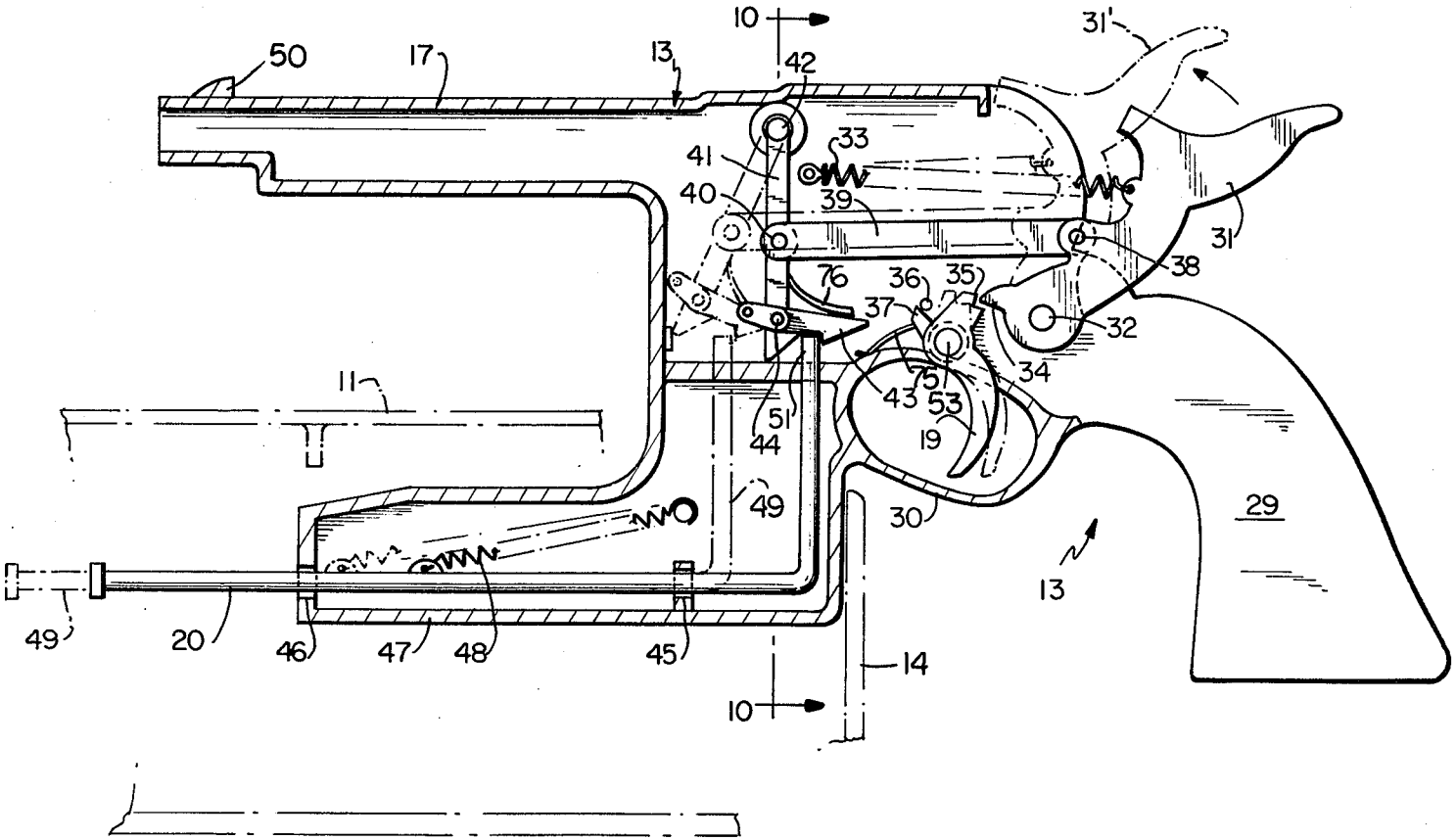
Figure 10:
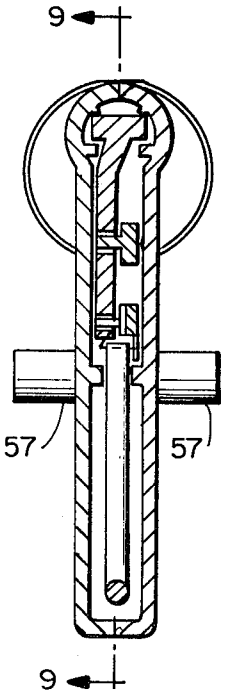

FIG. 9 is a cross-sectional view of the gun taken on line 9—9 of FIG. 10.

FIG. 10 is a cross-sectional view taken on line 10—10 of FIG. 9.

DETAILED DESCRIPTION OF DRAWINGS

Now with more particular reference to the drawings, the target game apparatus according to the invention is indicated generally at 10. The target game generally includes the track support 11 which has the track 12 supported on its top and which inclines downwardly from the first end 14 to the second end 70 thereof. The gun 13 is supported at the first end 14 of the track support 11 and it can be moved in both azimuth and elevation to aim it at the car 15, as the car runs by gravity down the track from the first end 14 next to the gun to the second end 70.

The gun 13 has a barrel 17 with a conventional sight on the top of it which can be aimed at the car 15 as it runs down the track and over the slots 16 in the top of the track support 11. A bell crank 21 is pivoted to the underside of the track support at 22 and the blade 18 is supported on the bell crank 21 and then extends up through the slot 16 in the track support 11. A rod 23 is connected to the bell crank at 24. The rod is supported for sliding movement in the bracket 25 that is attached to the bottom of the track support 11.

The gun 13 has the impact means 20 on it, and if the gun is sighted on the car as the car passes over the slot 16 and the trigger 19 of the gun is pulled at the time the car 15 is over the blade 18, the position held in FIG. 4, the impact means 20 of the gun will engage the end of the rod 23 adjacent it and cause the blade 18 to swing up through the slot 16 and knock the car off the track, as shown in FIG. 5.

Three stations are provided along the track. Each station has a slot **16*a*, 16*b*, and 16*c* with a bell crank 21*a*, 21*b* and 21*c* supported below it on the bottom of the track support on pivots 22*a*, 22*b* and 22*c*. The rods 23*a*, 23*b* and 23*c* are all supported in the manner shown in FIG. 4 and FIG. 5. The rods 23*a*, 23*b* and 23*c* all converge to a position adjacent to impact means 20 of the gun and are supported in the brackets 25**.

The gun 13 has a barrel 17 which overlies the track support 11 and the impact means 20 which extends below the track support. Thus, when the gun is sighted on the car 15 as the car passes over the particular slot **16*a*, 16*b* or 16*c* the impact means 20 will be aligned with the particular rod 23*a*, 23*b* or 23*c* which are connected to the bell cranks 21. When the gun barrel 17 is properly aligned with the car 15, and trigger 19 is pulled at the proper time, the impact member 20 will move to the position 49 indicated in FIG. 9** knocking the car off the track.

The target game 10 can also include stationary targets, such as the bell 28 which is rung by the same bell crank system employed to knock the cars off the track. The impact means 20 will impact the rod 25' when the gun 13 has been aimed at the bell 28 and the trigger 19 pulled. The rod 25' is connected to the bell crank 26 which rotates on pivot 27. When the blade 18 moves upwardly through the track support 11, it engages and moves upwardly a ringer which is in the form of a straight rod larger than the slot 16, which is slidably positioned inside the bell post 71 which is tubular in shape. The ringer slides upwardly inside the bell post 71 propelled by the blade 18 and engages the bell 28 and thus ringing it.

Other features can be added to add variety to the target game, such as a tunnel 72 which will obscure the moving car 15 from view, a score keeper 73 can be provided to keep track of the score while the game is in progress, and a car rack 74 can be provided to store the cars 15 when not in use.

The gun 13 is shown in detail in FIG. 9 and FIG. 10. The gun 13 has a trigger 19 pivoted at 53 to the gun frame 29 which has a conventional grip, trigger guard 30 and barrel 17 which extends above the track support 11 and an extension 47 that extends below the track support 11. The trigger 19 is operated by pulling it to the position shown in the phantom line at which point the seer 34 slips out of the notch 35 and the spring 33 pulls the mechanism forward and moves the impact member 20 forward. The trigger 19 is returned to its rest position, shown in full lines, by the spring 75 which pushes on the stop 37 which protrudes from the end of the trigger 19 until the stop 37 engages the pin 36 which limits the return of the trigger 19.

The hammer 31 is pivoted to the gun frame at 32 and urged forward by the tension spring 33 which is pivoted to the hammer 31 and to the gun frame. The seer 34 engages the notch 35 when the hammer is cocked. The hammer is connected to the swinging lever 41 by the pivot 40 and lever 41 is pivoted to the gun frame at 42. The latch 43 is pivoted to the lever 41 at 44 and it has a hook which engages behind the upwardly extending portion of the impact member 20. The impact member 20 is slidably supported in the hole 46 in the extension 47 and through a hole in the bracket 45.

To cock the gun, the operator pulls the hammer 31 from the uncocked position 31' shown in FIG. 9 in phantom line to the cocked position 31, which is shown in full line. This will stretch the spring 33. The link 39 pivoted at 38 to the hammer 31 will pull link 41 which is pivoted at 40 to link 39. Link 41 has latch 43 pivoted to it at 44 and spring 76 which urges the latch 43 downwardly. When the hammer 31 is cocked, the latch will slide over the upper end 51 of the impact member 20 and the spring 76 will force the latch downward into engagement with the impact member 20. Thus, when the trigger 19 is pulled, the spring 33 will force the impact member 20 to its extended position 49. The spring 48 will then return the impact member to its rest position shown in full lines. The spring 33 is far stronger than the spring 48.

With the hammer 31 and the impact member 20 in the full line position, the operator will start a car down the track from the first end 14. The operator will aim the sight 50 so that it will intercept the car as the car passes over one of the slots **16*a*, 16*b* or 16*c*. When the gun is properly aimed, the impact member 20 will be aligned with the particular rod 23*a*, 23*b* or 23*c*. Then when the operator pulls the trigger 19 at the exact instant that the car is over the particular opening 16, the impact member 20 will engage the particular rod 23** and knock the car off the track. If the operator does not have the impact member properly aligned or if he does not pull the trigger at the proper time, the car will not be knocked off.

It will be noted that the gimble members 52 will be received in the con-cavity 54 and held therein by the cap 55 with screws received in holes 56 in the table and holes 77 in the cap. The gun can be rotated by azimuth by the rotation of the members 52 in the con-cavity 54.

The pins 57 which extend laterally outward from the gun will be received in openings 58 in the members 52 allowing the gun to be moved in elevation.

It will be noted that the track has a starting section 59 that passes through curve 60 which is inclined downward and toward the left, straight section 61 is inclined downwardly and toward the right of the table passing through curve 62 and along track section 63 which is inclined downwardly and toward the left around curve 64 and down straight inclined section 65.

The top sections of the track support are inclined to accommodate the incline of the track.

The track has a continuous slot 66 in which the lug 67 on the bottom of the car moves. An upward extending track portion 68 at each side of the slot 66 provides a surface on which the wheels 69 of the car roll.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A target game apparatus comprising,
a track support,
an inclined track on said support,
a gun supported on a first end of said support,
at least one car supported on said track and moved by gravity down said track,
at least one station along said track,
said gun having a barrel adapted to sight on said car as it passes said station during its movement down said track,
a blade extending upwardly through said support, blade supporting means supporting said blade,
trigger means on said gun,
said gun having impact thereon below said track adapted to selectively engage said blade supporting means in response to activation of said trigger means for moving said blade upward through said track support and lifting said car from said track thereby interrupting said car's gravitational movement down said track.

2. The game recited in claim 1 wherein said blade supporting means comprises,
a bell crank means pivotally supported on the underside of said support and adapted to pivot and thereby move said blade upward through said track,
the impact means on said gun adapted to pivot said bell crank means for lifting said car from said track.

3. The game recited in claim 2 wherein said bell crank means has a rod engaging it, said rod being slidably supported on the underside of said track support, and said impact means engages said rod when said gun is sighted on said target whereby said car is lifted from said track.

4. The game recited in claim 3 wherein said impact means for engaging said rod comprises,
a second rod supported on said gun and adapted to be aligned with said first mentioned rod when said gun is sighted on said target.

5. The game recited in claim 4 wherein said track comprises,
a first section extending downwardly and toward a first side,
a second section extending downwardly and toward a second side,
a third section extending downwardly and toward said first side,
and a fourth section extending downwardly and toward the center of said support.

6. The game recited in claim 5 wherein three (3) said stations are provided and three (3) said blades extend through said support to engage said car, one said station being on said first track section, another station on the second track section and the third station on the third track section.

7. The target game recited in claim 6 wherein said track comprises,
a groove in said track and said car has a downwardly extending member adapted to slidably engage said groove for guiding said car on said track.

8. A target game comprising,
an inclined track having a top thereon,
means for movably supporting a target on said track to run down said track by gravity,
a gun mounted on one end of said track and means on said gun for permitting movement thereof in both azimuth and elevation, means extending through said track for engaging said target when said target is over said means for engaging said target during said target's movement down said track, impact means on said gun adapted to engage said means extending through said track for impacting said means extending through said track and causing engagement of said means extending through said track with said target.

9. The target game recited in claim 8 wherein said means for engaging said target comprises, a first rod slidably supported on said table such that said impact means on said gun impacts said first rod when said gun is sighted on said target.

10. The game recited in claim 9 wherein said impact means on said gun comprises, a second rod slidably supported on said gun, spring means urging said impact means for impacting said second rod said impact means comprising a rod extending generally parallel to the line of sight of said gun disposed in generally parallel spaced relation thereto.

11. The target game recited in claim 10 wherein said gun is mounted on said table by means of a generally horizontal axle member supported on said gun by generally half cylinder shaped support members supported one on each side of said gun, said support members being received in a recess in an end of said table being rotatable therein, said gun being movable on said axle in elevation, said gun having a barrel supported above said table top and said impact member comprising a rod supported below said table top.

12. A target game apparatus comprising, a track support, an inclined track on said support, a gun supported on a first end of said support, at least one car adapted to be supported on said track and to be moved by gravity down said track, at least one station along said track, said gun having a barrel adapted to sight on said car as it passes said station, a blade extending upwardly through said support, blade supporting means supporting said blade, trigger means on said gun, said gun having impact means thereon below said track adapted to selectively engage said blade supporting means for moving said blade upward through said track support and lifting said car from said track, said blade supporting means comprising, bell crank means pivotally supported on the underside of said support and adapted to pivot and thereby move said blade upward through said track, the impact means on said gun adapted to pivot said bell crank means for lifting said car from said track, said bell crank means having a rod engaging it, said rod being slidably supported on the underside of said track support and said impact means engages said rod when said gun is sighted on said target whereby said car is lifted from said track.

* * * * *